US012698578B2

(12) United States Patent
Vido et al.

(10) Patent No.: US 12,698,578 B2
(45) Date of Patent: Aug. 4, 2026

(54) POLYMERIC WRAPPING MATERIAL

(71) Applicant: Owens Corning Intellectual Capital, LLC, Toledo, OH (US)

(72) Inventors: Martin Vido, Surrey (CA); Haley Argersinger, Delaware, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 790 days.

(21) Appl. No.: 18/065,038

(22) Filed: Dec. 13, 2022

(65) Prior Publication Data

US 2023/0193529 A1 Jun. 22, 2023

Related U.S. Application Data

(60) Provisional application No. 63/290,069, filed on Dec. 16, 2021.

(51) Int. Cl.

| | |
|---|---|
| ***D03D 15/46*** | (2021.01) |
| ***D03D 1/00*** | (2006.01) |
| ***D03D 9/00*** | (2006.01) |
| ***D03D 15/283*** | (2021.01) |
| ***D06M 15/227*** | (2006.01) |

(Continued)

(52) U.S. Cl.

CPC ..... *D03D 15/46* (2021.01); *D03D 1/00* (2013.01); *D03D 9/00* (2013.01); *D03D 15/283* (2021.01); *D06M 15/227* (2013.01); *D06N 3/0006* (2013.01); *D06N 3/0088* (2013.01); *D06N 3/045* (2013.01); *D06N 3/183* (2013.01); *D06N 3/186* (2013.01); *D06M 2101/20* (2013.01); *D06M 2200/25* (2013.01); *D06N 2201/0254* (2013.01); *D06N 2203/042* (2013.01); *D06N 2209/0807* (2013.01); *D06N 2209/1678* (2013.01); *D06N 2211/00* (2013.01); *D10B 2401/20* (2013.01);

(Continued)

(58) Field of Classification Search

CPC ..... B32B 5/024; B32B 27/12

See application file for complete search history.

(56) References Cited

U.S. PATENT DOCUMENTS 4,043,085 A * 8/1977 Ochiai ..... B60P 7/04 52/63

4,239,831 A 12/1980 Pattenden (Continued)

FOREIGN PATENT DOCUMENTS

CN 205775072 U 12/2016

EP 0769585 A2 4/1997

(Continued)

OTHER PUBLICATIONS

International Search Report and Written Opinion from PCT/US22/81407 dated May 26, 2023.

(Continued)

*Primary Examiner* — Jenna L Johnson

(74) *Attorney, Agent, or Firm* — Calfee, Halter & Griswold LLP

(57) ABSTRACT

A wrapping material having three distinct polymeric layers interfaced with a woven polymeric scrim is disclosed. A first polymeric layer is formed by extruding a first polymeric coating onto the scrim. A second polymeric layer and a third polymeric layer are simultaneously formed by co-extruding a second polymeric coating onto the scrim and a third polymeric coating onto the second polymeric coating.

22 Claims, 11 Drawing Sheets

(51) Int. Cl.

| | |
|---|---|
| ***D06N 3/00*** | (2006.01) |
| ***D06N 3/04*** | (2006.01) |
| ***D06N 3/18*** | (2006.01) |
| *D06M 101/20* | (2006.01) |

(52) U.S. Cl.
CPC ..... *D10B 2401/22* (2013.01); *D10B 2505/10* (2013.01)

(56) References Cited

U.S. PATENT DOCUMENTS

| | | | | |
|---|---|---|---|---|
| 5,491,958 | A | 2/1996 | Hammer | |
| 5,699,646 | A | 12/1997 | Hammer | |
| 5,927,628 | A | 7/1999 | Lima et al. | |
| 5,994,242 | A * | 11/1999 | Arthurs | B32B 27/12 442/168 |
| 6,013,586 | A | 1/2000 | McGhee et al. | |
| 6,209,813 | B1 | 4/2001 | Lima et al. | |
| 6,279,295 | B1 | 8/2001 | Girard et al. | |
| 6,322,013 | B1 | 11/2001 | Lima et al. | |
| 6,367,513 | B1 | 4/2002 | Cain | |
| 6,371,292 | B1 | 4/2002 | McCown et al. | |
| 6,401,433 | B2 | 6/2002 | McCown et al. | |
| 6,460,314 | B1 | 10/2002 | Girard et al. | |
| 6,550,212 | B2 | 4/2003 | Lubker, II | |
| 6,761,006 | B2 | 7/2004 | Lubker, II | |
| 6,869,901 | B2 | 3/2005 | Lubker, II | |
| 7,109,135 | B2 | 9/2006 | Taghavi | |
| 7,196,024 | B2 | 3/2007 | Lubker, II | |
| 7,309,665 | B2 | 12/2007 | Qureshi et al. | |
| 7,749,924 | B2 | 7/2010 | Peng | |
| 7,882,671 | B2 * | 2/2011 | Bruce | B32B 27/08 264/173.14 |
| 7,992,596 | B2 | 8/2011 | Khokar | |
| 8,129,294 | B2 | 3/2012 | Khokar | |
| 8,334,223 | B2 | 12/2012 | Lubker, II | |
| 9,157,173 | B2 | 10/2015 | Westoby | |
| 9,656,445 | B2 | 5/2017 | Lubker, II | |
| 9,769,992 | B2 | 9/2017 | Jacobs | |
| 9,855,728 | B2 | 1/2018 | Lubker, II | |
| 10,030,325 | B2 | 7/2018 | Arthurs | |
| 10,041,207 | B2 | 8/2018 | Martin | |
| 10,118,363 | B2 | 11/2018 | Seth et al. | |
| 10,124,557 | B2 | 11/2018 | Seth et al. | |
| 10,232,585 | B2 | 3/2019 | Seth et al. | |
| 10,279,771 | B2 | 5/2019 | Westoby | |
| 10,710,295 | B2 | 7/2020 | Arthurs | |
| 2002/0074258 | A1 | 6/2002 | McCown et al. | |
| 2003/0064647 | A1 | 4/2003 | Chang | |
| 2003/0114285 | A1 | 6/2003 | McCown et al. | |
| 2005/0054252 | A1 * | 3/2005 | Baciu | B32B 27/20 442/268 |
| 2005/0130525 | A1 | 6/2005 | Sanchez et al. | |
| 2005/0170724 | A1 | 8/2005 | Ki | |
| 2005/0260906 | A1 | 11/2005 | Chang | |
| 2006/0166577 | A1 * | 7/2006 | Rashed | D03D 1/007 442/131 |
| 2006/0194494 | A1 | 8/2006 | Lubker, II | |
| 2006/0194495 | A1 | 8/2006 | Lubker, II | |
| 2006/0205305 | A1 | 9/2006 | Chang | |
| 2007/0059999 | A1 | 3/2007 | Arthurs | |
| 2007/0194482 | A1 | 8/2007 | Douglas et al. | |
| 2008/0134622 | A1 | 6/2008 | Lubker, II | |
| 2009/0181216 | A1 | 7/2009 | Peng | |
| 2009/0269565 | A1 | 10/2009 | Peng | |
| 2010/0178827 | A1 | 7/2010 | Thai et al. | |
| 2010/0247872 | A1 | 9/2010 | Seth et al. | |
| 2012/0178322 | A1 | 7/2012 | Mehta et al. | |
| 2012/0244315 | A1 | 9/2012 | Barrego | |
| 2016/0325523 | A1 | 11/2016 | Seth et al. | |
| 2019/0299563 | A1 | 10/2019 | Seth et al. | |

FOREIGN PATENT DOCUMENTS

| | | | |
|---|---|---|---|
| EP | 1595986 | A1 | 11/2005 |
| WO | 9413496 | A1 | 6/1994 |
| WO | 2011045136 | A1 | 4/2011 |
| WO | 2016109184 | A1 | 7/2016 |
| WO | 2020243501 | A1 | 12/2020 |
| WO | 2021050225 | A1 | 3/2021 |

OTHER PUBLICATIONS

Extended European Search Report from EP Application No. 22908610.3 dated Nov. 13, 2025.

* cited by examiner

DETAIL X

DETAIL X

POLYMERIC WRAPPING MATERIAL

CROSS-REFERENCE TO RELATED APPLICATION(S)

This application claims priority to and the benefit of U.S. Provisional Patent Application No. 63/290,069, filed Dec. 16, 2021, the entire content of which is incorporated by reference herein.

FIELD

The general inventive concepts relate to wrapping materials and, more particularly, to a polymeric wrapping material that prevents significant or noticeable discoloration of a wrapped article.

BACKGROUND

During shipping of lumber, the lumber is often wrapped in a material that protects the lumber from any environmental conditions (e.g., rain, dirt, snow, etc.). The wrapping material also protects lumber that is stored prior to use. The wrapping material is typically wrapped around the lumber and then fastened (e.g., stapled, belted) to secure the wrapping material to or around the lumber. It is known for the wrapping material to be made of a polymeric material, such as polypropylene or polyethylene.

As shown in FIG. 1, a conventional polymeric wrapping material 100 is formed as a sheet 102 having a sheet length/and a sheet width w.

The sheet 102 of the wrapping material 100 is generally composed of polypropylene (PP) tapes that are woven together to form the wrapping material 100 (see FIG. 1B). More specifically, first PP tapes 110 that are fed in a machine direction indicated by arrow 120 are woven with second PP tapes 112 that are fed in a cross-machine (or transverse) direction indicated by arrow 122. The first PP tapes 110 are considered warp tapes, while the second PP tapes 112 are considered weft tapes. The machine direction 120 is parallel to the sheet length/and perpendicular to the sheet width w. The cross-machine direction 122 is parallel to the sheet width w and perpendicular to the sheet length 1.

The sheet 102 includes two main faces 104 and 106. The faces 104, 106 are opposite one another. The face 104 is considered the outer face, while the face 106 is consider the inner face. When the sheet 102 is installed (e.g., wrapped around a quantity of lumber), a significant portion (if not all) of the outer face 104 remains visible, while a significant portion (if not all) of the inner face 106 cannot be seen. In other words, the inner face 106 is the side of the sheet 102 that contacts the lumber, while the outer face 104 is the side of the sheet 102 that does not contact the lumber.

Often, the sheet 102 includes a first polymeric coating 130 on the outer face 104 that forms a relatively uniform marking layer 132 (see FIGS. 2 and 3). The coating 130 can be extruded onto the outer face 104. The coating 130 has a white color that readily supports the inclusion of information 108 applied (e.g., printed) thereon. The light color of the coating 130 can be achieved by pigments, fillers, etc.

In a first conventional wrapping material 200, the sheet 102 includes a second polymeric coating 140 on the inner face 106 that forms a relatively uniform UV-blocking layer 142 (see FIG. 2). The coating 140 can be extruded onto the inner surface 106. The coating 140 has a black color that is effective at limiting passage of UV light through the wrapping material 200. The UV-blocking (dark) color of the coating 140 can be achieved by pigments, fillers, etc. Without the UV-blocking layer 142, UV light could travel through the wrapping material 200 to discolor (e.g., darken) the covered lumber. More problematic is that this discoloration will typically be non-uniform as the result of some blockage of the UV light by any information 108, belts, folded-portions of wrapping material 200, etc. The discoloration typically requires sanding, cleaning, or other treatment of the lumber to remove the affected portions.

In a second conventional wrapping material 300, the sheet 102 includes a second polymeric coating 150 on the inner face 106 that forms a relatively uniform cover layer 152 (see FIG. 3). The coating 150 can be extruded onto the inner surface 106. The coating 150 has a beige color that is effective at limiting transfer of portions of the sheet 102 onto the lumber. The wood-like color of the coating 150 can be achieved by pigments, fillers, etc. Without the cover layer 152, portions of the white (that is, less wood-like colored) sheet 102 could be transferred from the wrapping material 300 to the lumber, when the wrapping material 300 contacts or rubs against the lumber, resulting in discolored portions on the lumber. This transfer of the sheet material 102 to the lumber is more likely to occur under straps or at other points of increased pressure. The resulting discoloration typically requires sanding, cleaning, or other treatment of the lumber to remove the affected portions. However, because the cover layer 152 has a more wood-like color, any transfer of material from the cover layer 152 to the lumber is less likely to be considered problematic, that is, less likely to require remediation.

Nonetheless, the conventional wrapping materials 200, 300 suffer from drawbacks. In particular, the black color of the UV blocking layer 142 of the wrapping material 200 makes any transfer of material from the UV blocking layer 142 to the lumber problematic. Additionally, because the cover layer 152 of the wrapping material 300 is ineffective at blocking UV light, the lumber can be exposed to UV light (typically in a non-uniform manner) that discolors the lumber. In each instance, the covered lumber is likely to experience discoloring necessitating sanding, cleaning, or other treatment of the lumber to remove the affected portions.

In view of the above, there is an unmet need for a wrapping material that overcomes any one or more of these drawbacks, that overcomes other drawbacks, and/or that exhibits improved performance.

SUMMARY

The general inventive concepts relate to a wrapping material comprising a polymeric sheet/scrim and multiple polymeric layers formed thereon. In particular, the wrapping material includes both a UV-blocking layer and a cover layer.

In one exemplary embodiment, a wrapping material comprises a sheet comprising a plurality of first polymeric tapes and a plurality of second polymeric tapes, the first and second polymeric tapes being interwoven; a first polymeric coating applied to a first side of the sheet; a second polymeric coating applied to a second side of the sheet; and a third polymeric coating applied to the second polymeric coating.

In some exemplary embodiments, the sheet has a width in the range of 1.22 m to 3.86 m.

In some exemplary embodiments, the sheet has a length greater than the width. In some exemplary embodiments, the sheet has a length at least two times greater than the width.

In some exemplary embodiments, the sheet has a length at least three times greater than the width.

In some exemplary embodiments, the sheet has a (single ply, non-folded) thickness in the range of 0.03 mm to 0.2 mm.

In some exemplary embodiments, the sheet has a weight in the range of 25 g/m$^2$ to 100 g/m$^2$. In some exemplary embodiments, the sheet has a weight in the range of 33 g/m$^2$ to 71 g/m$^2$. In some exemplary embodiments, a weight of the sheet is about 58.3 g/m$^2$.

In some exemplary embodiments, the first polymeric tapes comprise at least one of polypropylene and polyethylene.

In some exemplary embodiments, the second polymeric tapes comprise at least one of polypropylene and polyethylene.

In some exemplary embodiments, the first polymeric tapes have a width in the range of 2 mm to 8 mm.

In some exemplary embodiments, the second polymeric tapes have a width in the range of 2 mm to 8 mm.

In some exemplary embodiments, a width of the first polymeric tapes differs from a width of the second polymeric tapes.

In some exemplary embodiments, the first polymeric coating is substantially white in color. It will be understood that "substantially white" can encompass very light colors (e.g., yellow, gray), such as when the luminance is low.

In some exemplary embodiments, the first polymeric coating has an L* value>60, in the CIELAB color space (measured according to the D65 Standard Illuminant and the 10-degree Standard Observer). If the first polymeric coating has a non-homogenous or varied color scheme, then an average of the color units (e.g., pixels in an image of the first polymeric coating) has an L* value>60, in the CIELAB color space (measured according to the D65 Standard Illuminant and the 10-degree Standard Observer).

In some exemplary embodiments, the first polymeric coating comprises at least one of polypropylene and polyethylene.

In some exemplary embodiments, the first polymeric coating forms a marking layer of the wrapping material, the marking layer suitable for printing indicia thereon. In some exemplary embodiments, the indicia includes text. In some exemplary embodiments, the indicia includes graphics.

In some exemplary embodiments, a thickness of the marking layer is in the range of 0.01 mm to 0.04 mm. In some exemplary embodiments, a thickness of the marking layer is in the range of 0.019 mm to 0.0376 mm.

In some exemplary embodiments, a weight of the first polymeric coating is in the range of 10 g/m$^2$ to 40 g/m$^2$. In some exemplary embodiments, a weight of the first polymeric coating is in the range of 18 g/m$^2$ to 24 g/m$^2$. In some exemplary embodiments, a weight of the first polymeric coating is about 21 g/m$^2$.

In some exemplary embodiments, the second polymeric coating is substantially black in color. It will be understood that "substantially black" can encompass very dark colors (e.g., blue, green), such as when the luminance is high.

In some exemplary embodiments, the second polymeric coating has an L* value<30, in the CIELAB color space (measured according to the D65 Standard Illuminant and the 10-degree Standard Observer). If the second polymeric coating has a non-homogenous or varied color scheme, then an average of the color units (e.g., pixels in an image of the second polymeric coating) has an L* value<30, in the CIELAB color space (measured according to the D65 Standard Illuminant and the 10-degree Standard Observer).

In some exemplary embodiments, the second polymeric coating comprises at least one of polypropylene and polyethylene.

In some exemplary embodiments, the second polymeric coating forms a UV-blocking layer of the wrapping material, the UV-blocking layer operable to block UV light from passing through the UV-blocking layer.

In some exemplary embodiments, a thickness of the UV-blocking layer is in the range of 0.005 mm to 0.038 mm. In some exemplary embodiments, a thickness of the UV-blocking layer is in the range of 0.005 mm to 0.03 mm. In some exemplary embodiments, a thickness of the UV-blocking layer is in the range of 0.014 mm to 0.018 mm.

In some exemplary embodiments, a weight of the second polymeric coating is in the range of 5 g/m$^2$ to 38 g/m$^2$. In some exemplary embodiments, a weight of the second polymeric coating is in the range of 5 g/m$^2$ to 30 g/m$^2$. In some exemplary embodiments, a weight of the second polymeric coating is in the range of 13.5 g/m$^2$ to 18 g/m$^2$. In some exemplary embodiments, a weight of the second polymeric coating is about 14.5 g/m$^2$.

In some exemplary embodiments, the third polymeric coating is selected to approximate a significant color of the article to be wrapped.

In some exemplary embodiments, the third polymeric coating comprises at least one of polypropylene and polyethylene.

In some exemplary embodiments, the third polymeric coating forms a cover layer of the wrapping material.

In some exemplary embodiments, a thickness of the cover layer is in the range of 0.002 mm to 0.022 mm. In some exemplary embodiments, a thickness of the cover layer is in the range of 0.004 mm to 0.006 mm.

In some exemplary embodiments, a weight of the third polymeric coating is in the range of 2 g/m$^2$ to 22 g/m$^2$. In some exemplary embodiments, a weight of the third polymeric coating is in the range of 4.5 g/m$^2$ to 6 g/m$^2$. In some exemplary embodiments, a weight of the third polymeric coating is about 6 g/m$^2$.

In some exemplary embodiments, a combined thickness of the UV-blocking layer and the cover layer is in the range of 0.01 mm to 0.04 mm. In some exemplary embodiments, a combined thickness of the UV-blocking layer and the cover layer is in the range of 0.018 mm to 0.022 mm.

In some exemplary embodiments, the first polymeric coating forms a marking layer of the wrapping material, the second polymeric coating forms a UV-blocking layer of the wrapping material; and the third polymeric coating forms a cover layer of the wrapping material, wherein a thickness of the sheet is greater than a combined thickness of the marking layer, the UV-blocking layer, and the cover layer.

In some exemplary embodiments, the first polymeric coating forms a marking layer of the wrapping material; the second polymeric coating forms a UV-blocking layer of the wrapping material; and the third polymeric coating forms a cover layer of the wrapping material, wherein a thickness of the marking layer is about the same as a combined thickness of the UV-blocking layer and the cover layer.

In some exemplary embodiments, a combined weight of the second polymeric coating and the third polymeric coating is in the range of 10 g/m$^2$ to 40 g/m$^2$. In some exemplary embodiments, a combined weight of the second polymeric coating and the third polymeric coating is about 25.5 g/m$^2$. In some exemplary embodiments, a combined weight of the second polymeric coating and the third polymeric coating is in the range of 18 g/m$^2$ to 24 g/m$^2$. In some exemplary embodiments, a combined weight of the second polymeric coating and the third polymeric coating is about 20.5 g/m$^2$.

In some exemplary embodiments, a weight of the first polymeric coating is greater than a weight of the second polymeric coating.

In some exemplary embodiments, a weight of the first polymeric coating is greater than a weight of the third polymeric coating.

In some exemplary embodiments, a weight of the second polymeric coating is at least two times greater than a weight of the third polymeric coating.

In some exemplary embodiments, a weight of the second polymeric coating is at least three times greater than a weight of the third polymeric coating.

In some exemplary embodiments, a weight of the first polymeric coating is about the same as a combined weight of the second polymeric coating and the third polymeric coating.

In one exemplary embodiment, a wrapping material comprises a sheet comprising a plurality of first polymeric tapes and a plurality of second polymeric tapes, the first and second polymeric tapes being interwoven; a UV-blocking layer disposed on a first side of the sheet; and a cover layer disposed on the UV-blocking layer.

In some exemplary embodiments, the wrapping material further comprises a marking layer disposed on a second side of the sheet.

In some exemplary embodiments, the UV-blocking layer is substantially black in color. It will be understood that "substantially black" can encompass very dark colors (e.g., blue, green), such as when the luminance is high.

In some exemplary embodiments, the UV-blocking layer has an L* value<30, in the CIELAB color space (measured according to the D65 Standard Illuminant and the 10-degree Standard Observer). If the UV-blocking layer has a non-homogenous or varied color scheme, then an average of the color units (e.g., pixels in an image of the UV-blocking layer) has an L* value<30, in the CIELAB color space (measured according to the D65 Standard Illuminant and the 10-degree Standard Observer).

In some exemplary embodiments, the cover layer has a color that approximates a color of the article to be wrapped. In other words, the color of the cover layer is chosen to minimize the visual impact on the wrapped article should any of the cover layer transfer from the wrapping material to the wrapped article. When intended for use in wrapping lumber, a color of the cover layer is selected to approximate a common color of the lumber, such as a beige color. For example, beige can be considered to have a value of (245, 245, 220) in the standard RGB color space.

In some exemplary embodiments, the marking layer is substantially white in color. It will be understood that "substantially white" can encompass very light colors (e.g., yellow, gray), such as when the luminance is low.

In some exemplary embodiments, the marking layer has an L* value>60, in the CIELAB color space (measured according to the D65 Standard Illuminant and the 10-degree Standard Observer). If the marking layer has a non-homogenous or varied color scheme, then an average of the color units (e.g., pixels in an image of the marking layer) has an L* value>60, in the CIELAB color space (measured according to the D65 Standard Illuminant and the 10-degree Standard Observer).

In one exemplary embodiment, a method of manufacturing a wrapping material is disclosed, wherein the method comprises providing a polymer feedstock; forming first polymeric tapes from the feedstock; forming second polymeric tapes from the feedstock; weaving the first polymeric tapes and the second polymeric tapes to form a polymeric scrim; applying a first polymeric coating to a first side of the polymeric scrim; and simultaneously applying a second polymeric coating to a second side of the polymeric scrim and a third polymeric coating to the second polymeric coating.

In some exemplary embodiments, the method further comprises applying a polymeric coating to the polymeric scrim, before application of the first polymeric coating, the second polymeric coating, and the third polymeric coating.

In one exemplary embodiment, a method of wrapping an object is disclosed. The method comprises placing a wrapping material according to any of the above-described embodiments over the object; and fixing the wrapping material relative to the object using one or more fasteners (e.g., staples, belts).

Other aspects and features of the general inventive concepts will become more readily apparent to those of ordinary skill in the art upon review of the following description of various exemplary embodiments in conjunction with the accompanying figures.

BRIEF DESCRIPTION OF THE DRAWINGS

The general inventive concepts, as well as embodiments and advantages thereof, are described below in greater detail, by way of example, with reference to the drawings in which:

FIG. 1A is a top plan view of the wrapping material. FIG. 1B is a detailed view of the sheet used to form the wrapping material.

FIG. 4A is a top plan view of the wrapping material.

FIG. 4B is a detailed view of the sheet used to form the wrapping material. FIG. 4C is a diagram showing different layers of the wrapping material.

FIG. 6A is a diagram showing a piece of the wrapping material being separated from a roll in proximity to the article. FIG. 6B is a diagram showing the piece of wrapping material being fit over/around the article. FIG. 6C is a diagram showing the piece of wrapping material being secured to/around the article.

DETAILED DESCRIPTION

Several illustrative embodiments will be described in detail with the understanding that the present disclosure merely exemplifies the general inventive concepts. Embodiments encompassing the general inventive concepts may take various forms and the general inventive concepts are not intended to be limited to the specific embodiments described herein.

The general inventive concepts encompass a wrapping material comprising a polymeric sheet on which are formed three distinct layers, i.e., a marking layer, a UV-blocking layer, and a cover layer. While the polymeric sheet is the structural backbone of the wrapping material, the combination of coatings applied thereto impart functionality and synergies not realized in conventional wrapping materials. Furthermore, since at least two of the coatings are applied to the polymeric sheet simultaneously, less material can be used in forming the resulting layers, while also achieving increased manufacturing efficiency (e.g., reduced production time).

The general inventive concepts also encompass a wrapping material comprising a polymeric sheet, wherein the wrapping material includes both a UV-blocking layer and a cover layer, and wherein the UV-blocking layer is sandwiched between the polymeric sheet and the cover layer. In some exemplary embodiments, the wrapping material also includes a marking layer.

In some exemplary embodiments, the polymeric sheet is a woven scrim formed from polymeric tapes. In some exemplary embodiments, the polymeric tapes are made of at least one of polypropylene and polyethylene.

Figure 1A:
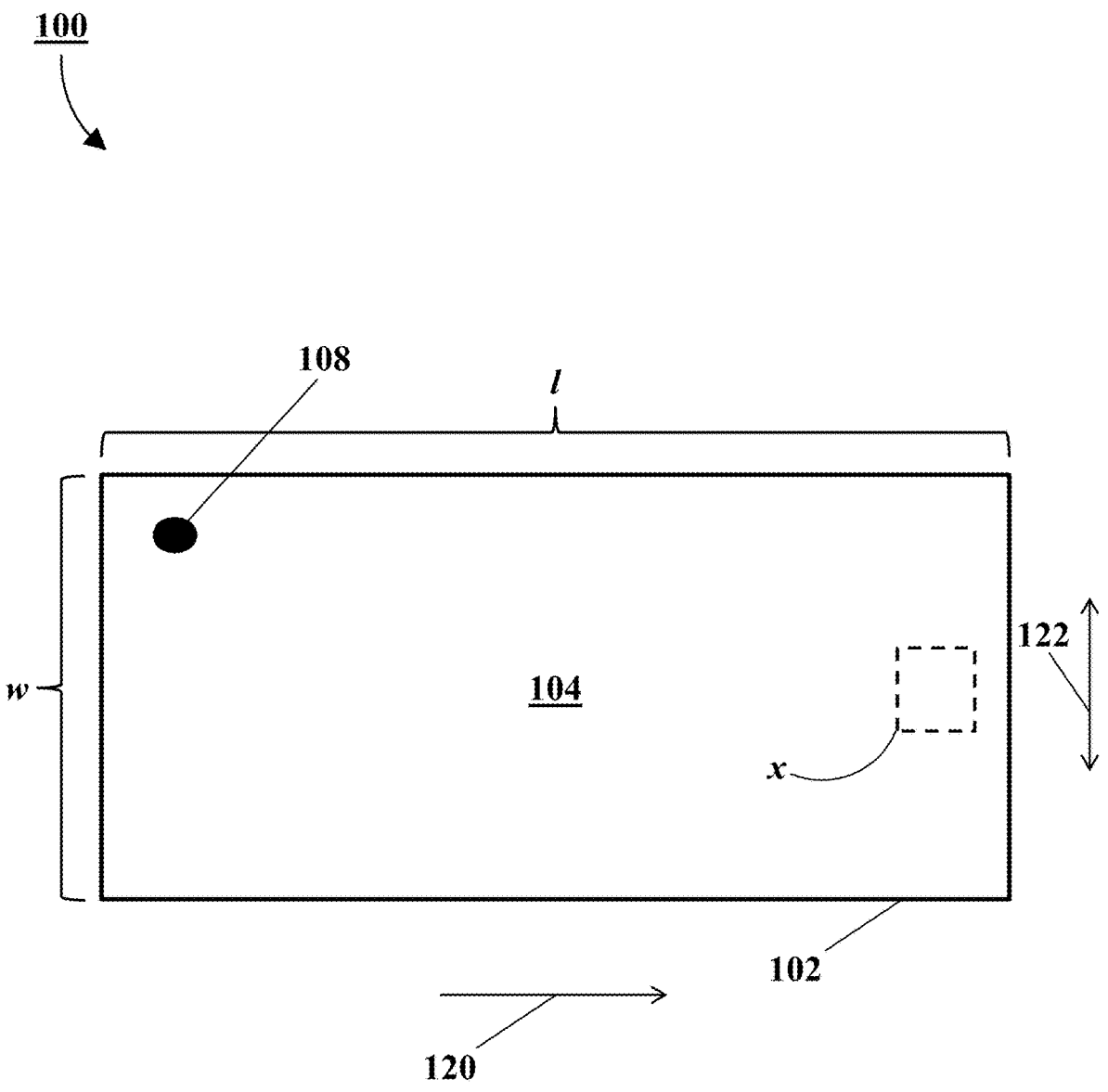
FIG. 1A PRIOR ART
FIGS. 1A-1B illustrate a conventional polymeric wrapping material.
Figure 1B:
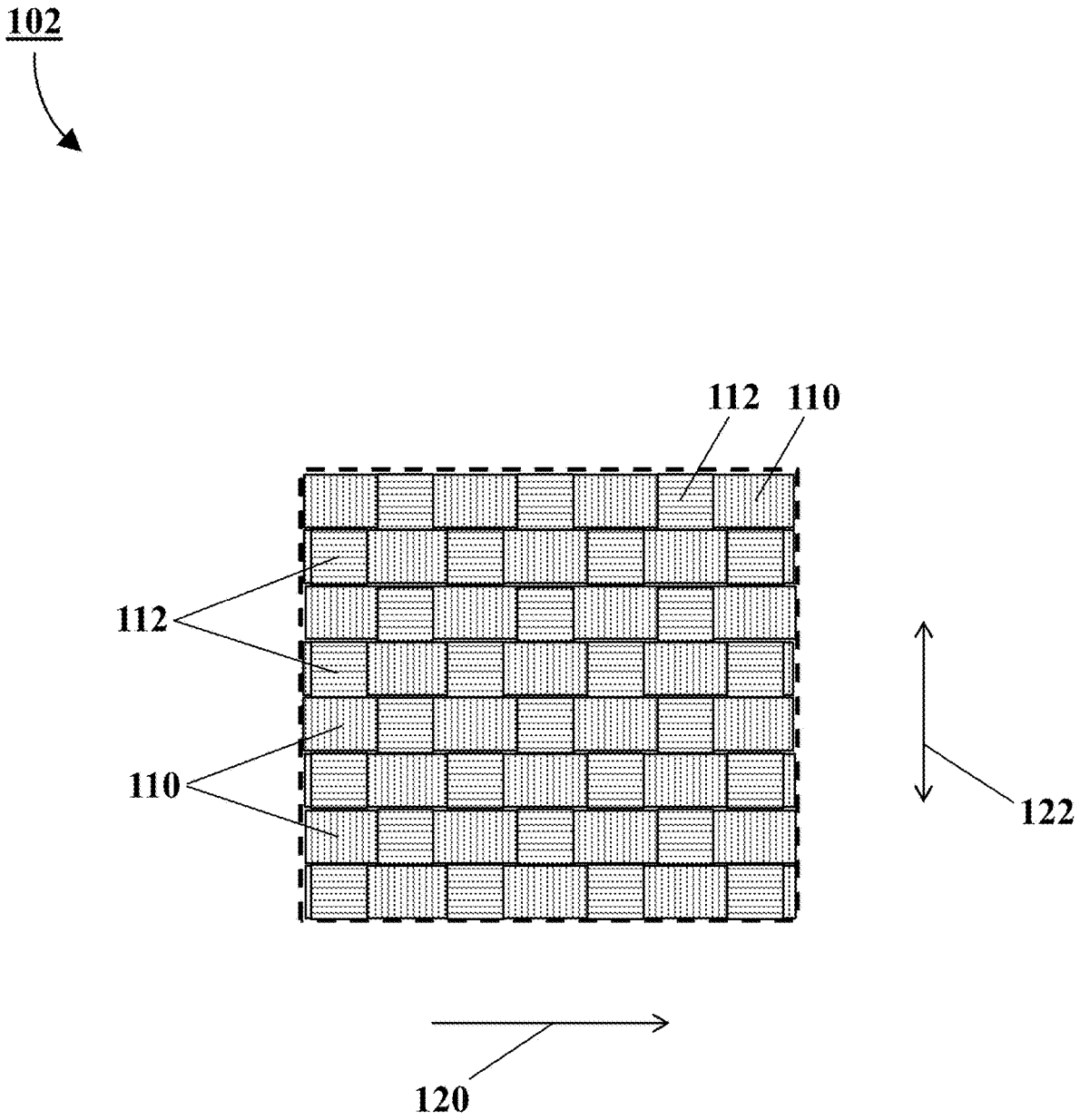
FIG. 1B PRIOR ART
Figure 2:
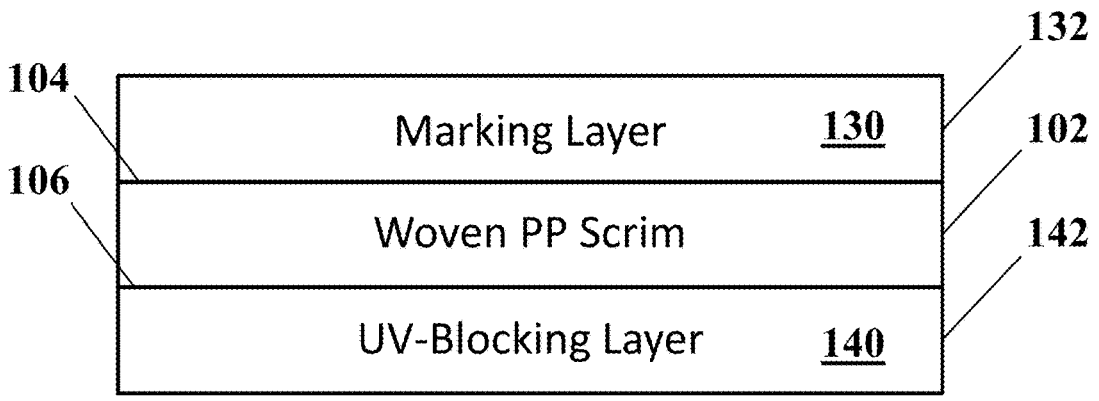
FIG. 2 PRIOR ART
FIG. 2 is a diagram showing different layers of a first conventional coated polymeric wrapping material.
Figure 3:
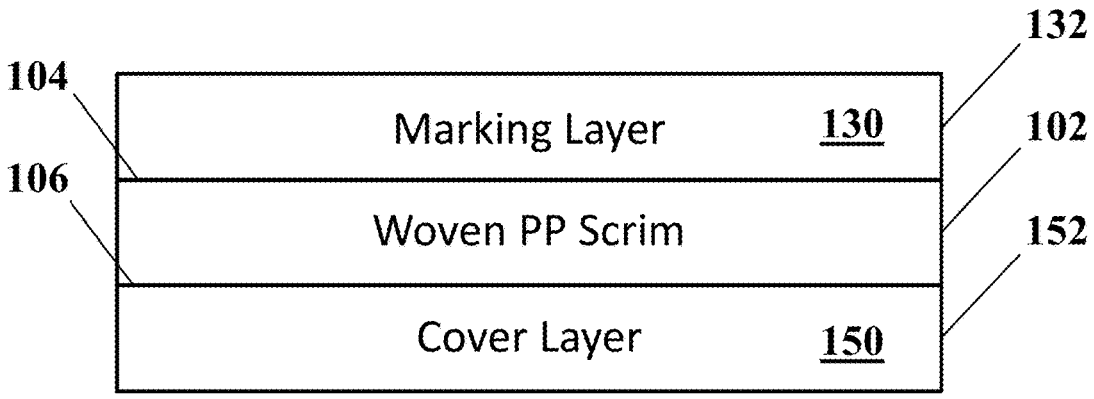
FIG. 3 PRIOR ART
FIG. 3 is a diagram showing different layers of a second conventional coated polymeric wrapping material.
Figure 4A:
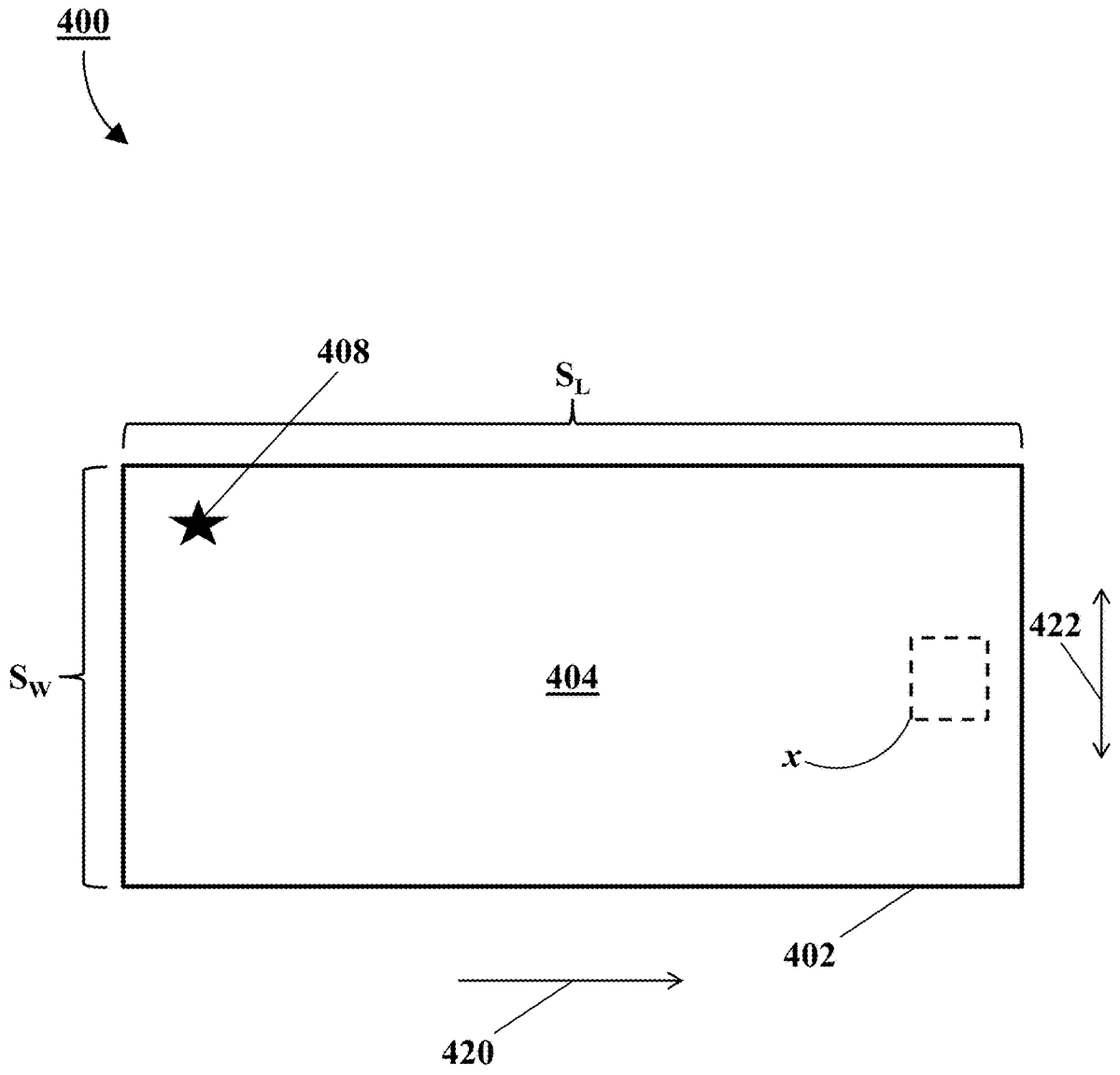
FIGS. 4A-4C are diagrams illustrating a coated polymeric wrapping material, according to an exemplary embodiment.
Figure 4B:
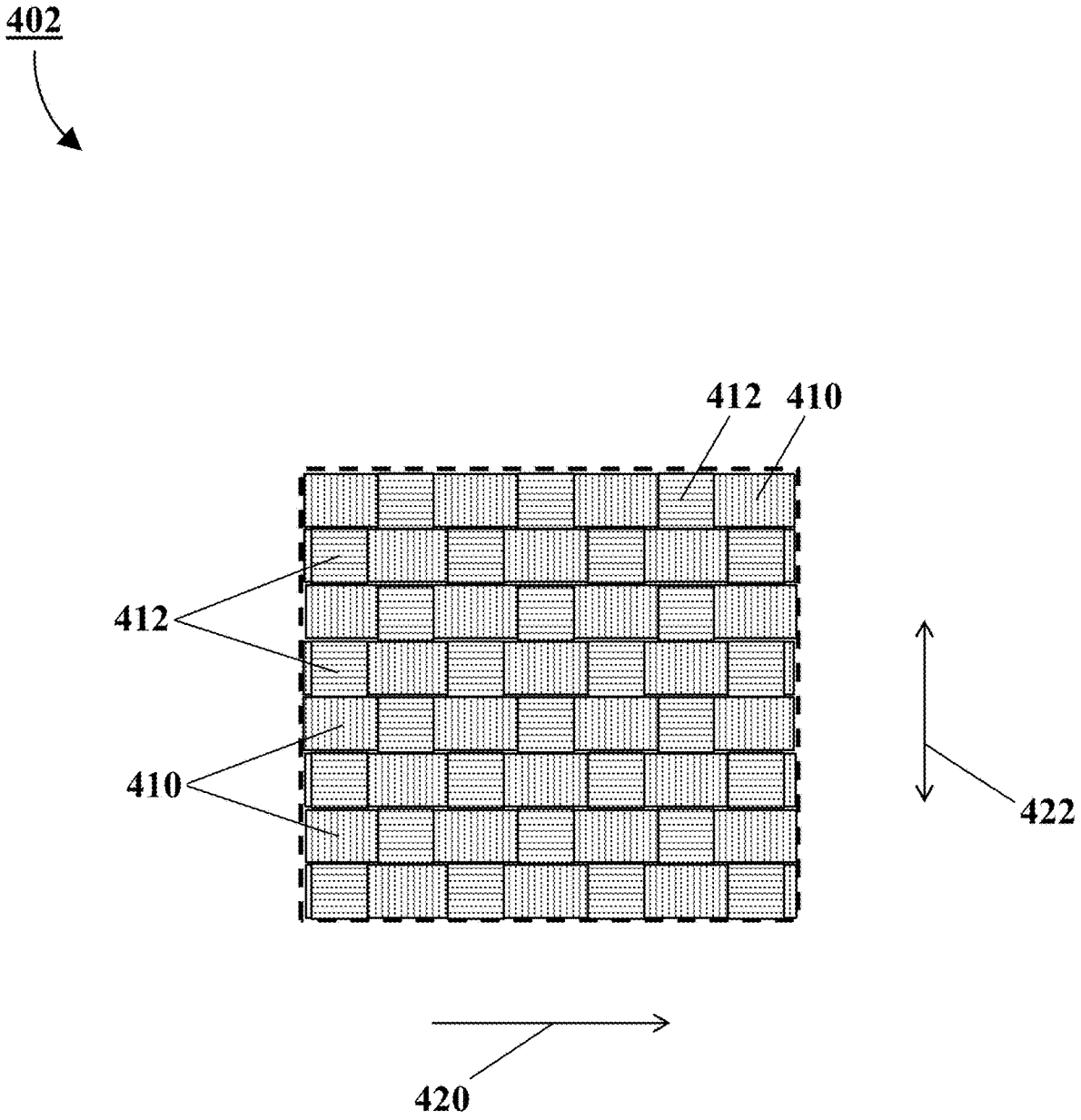
Figure 4C:
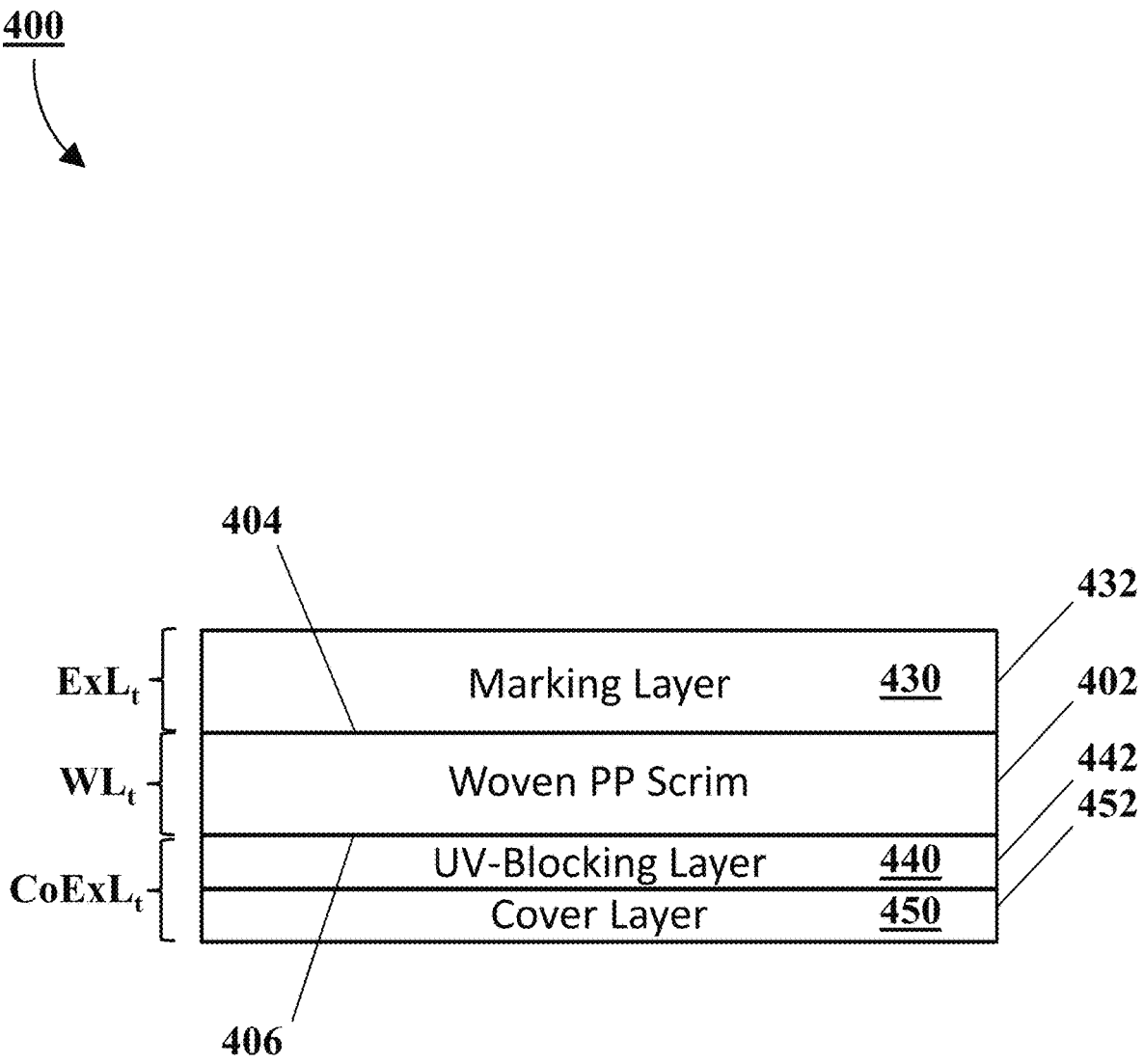

An exemplary polymeric wrapping material 400, which encompasses the general inventive concepts, is shown in FIGS. 4A-4C. The wrapping material 400 is formed as a sheet 402 having a sheet length $S_L$ and a sheet width $S_W$. In some exemplary embodiments, the sheet width $S_W$ is in the range of 1.22 m to 3.86 m. In some exemplary embodiments, the sheet length $S_L$ is greater than the sheet width $S_W$. In some exemplary embodiments, the sheet length $S_L$ is at least two times greater than the sheet width $S_W$. In some exemplary embodiments, the sheet length $S_L$ is at least three times greater than the sheet width $S_W$.

It is also contemplated that the wrapping material 400 could be made larger by joining (e.g., welding, sewing, gluing) multiple sheets 402 together. For example, if x sheets 402 are joined together or otherwise interfaced with one another, then the sheet width $S_W$ could be extended to almost any size, such as in the range of 1.22 m*x to 3.86 m*x.

By way of example, for those applications where the wrapping material 400 will be packaged on a roll for use downstream, the sheet length $S_L$ and the sheet width $S_W$ are selected to correspond to a desired package size. In this case, a user can install the roll of the wrapping material 400 in a manner whereby the wrapping material 400 can be unrolled and pieces cut off for use thereof (see FIGS. 6A-6C). It will be appreciated that the roll could be used in a manual wrapping process or an automated wrapping process.

As another example, for those applications where the wrapping material 400 will be used to create a pre-sewn cover, the sheet length $S_L$ and the sheet width $S_W$ are selected to correspond to the desired dimensions of the cover. Again, it will be appreciated that the cover could be used in a manual wrapping process or an automated wrapping process.

It will be appreciated that the general inventive concepts are readily applicable to other dimensions for $S_L$ and $S_W$. Furthermore, the wrapping material 400 could be modified (e.g., cut, folded) to wrap smaller-sized articles, while multiple sheets could be combined (e.g., welded, stitched) to wrap larger-sized articles.

The sheet 402 of the wrapping material 400 is generally composed of polypropylene (PP) tapes that are woven together to form the wrapping material 400. More specifically, as shown in FIG. 4B, first PP tapes 410 that are fed in a machine direction indicated by arrow 420 are woven with second PP tapes 412 that are fed in a cross-machine (or transverse) direction indicated by arrow 422. The first PP tapes 410 are considered warp tapes, while the second PP tapes 412 are considered weft tapes. The machine direction 420 is parallel to the sheet length $S_L$ and perpendicular to the sheet width $S_W$. The cross-machine direction 422 is parallel to the sheet width $S_W$ and perpendicular to the sheet length $S_L$.

Each of the first PP tapes 410 and the second PP tapes 412 can have any suitable width. These widths can vary from 2 mm to 8 mm. The tapes 410, 412 can have different widths relative to each other in different embodiments.

For example, in one exemplary embodiment, the sheet 402 is formed with a ratio of 2:1 warp tapes to weft tapes. Put another way, in this embodiment, there are roughly 10 warp tapes per inch and roughly 5 weft tapes per inch. Since 1 inch equals 25.4 mm, the tape widths are selected to approximate these dimensions. More specifically, in this embodiment, the first PP tapes 410 have a width of 2.5 mm and a weight of 888 dTex; the second PP tapes 412 have a width of 5.1 mm and a weight of 1,260 dTex.

In some exemplary embodiments, production of the sheet 402 is completed by application of a polypropylene coating thereon. The polypropylene coating can be applied in any suitable manner, such as by extrusion coating. The coating can be applied to either side or both sides of the sheet 402. This coating is intended to close the interstices between the tapes 410, 412 to form a weather (e.g., moisture) barrier.

The first PP tapes 410 and the second PP tapes 412 can be woven in any conventional manner, such as by a standard loom. If a circular loom is used to increase throughput, the resulting cylindrical member can be slit to form a flat sheet (e.g., the sheet 402).

The sheet 402 includes two main faces 404 and 406. The faces 404, 406 are opposite one another. The face 404 is considered the outer face, while the face 406 is consider the inner face. When the sheet 402 is installed (e.g., wrapped around a quantity of lumber), a significant portion (if not all) of the outer face 404 remains visible, while a significant portion (if not all) of the inner face 406 cannot be seen. In other words, the inner face 406 is the side of the sheet 402 that contacts the lumber, while the outer face 404 is the side of the sheet 402 that does not contact the lumber.

The sheet 402 includes a first polymeric coating 430 on the outer face 404 that forms a relatively uniform marking layer 432 (see FIG. 4C). In some exemplary embodiments, the polymeric coating 430 comprises polypropylene. In some exemplary embodiments, the coating 430 is extruded onto the outer face 404. In some exemplary embodiments, the coating 430 covers the entire outer face 404 of the sheet 402. The coating 430 has a white, white-like, or lighter colored appearance that readily supports the inclusion of text, symbols/logos, pictures, or the like (collectively "indicia" 408) thereon. For example, this indicia 408 can be applied to the set coating 430 on the outer face 404 by printing. The light color of the coating 430 can be achieved by pigments, fillers ($CaCo_3$), etc.

The sheet 402 also includes a second polymeric coating 440 on the inner face 406 that forms a relatively uniform UV-blocking layer 442 (see FIG. 4C). In some exemplary embodiments, the polymeric coating 440 comprises polypropylene. In some exemplary embodiments, the coating 440 covers the entire inner face 406 of the sheet 402. The coating 440 has a black, black-like, or darker colored appearance that is effective at limiting passage of UV light through the wrapping material 400. The UV-blocking layer 442 effectively prevents (or otherwise substantially reduces) the passage of UV light through the wrapping material 400 to avoid or mitigate any resulting discoloration (e.g., darkening) of the covered lumber.

The sheet 402 also includes a third polymeric coating 450 that forms a relatively uniform cover layer 452 (see FIG. 4C). In some exemplary embodiments, the polymeric coating 450 comprises polypropylene. The third polymeric coating 450 is situated on the second polymeric coating 440, such that the UV-blocking layer 442 is sandwiched between the inner face 406 of the sheet 402 and the cover layer 452. The third polymeric coating 450 will typically have a color that approximates a color of the article to be wrapped. In other words, the color of the cover layer is chosen to minimize the visual impact on the wrapped article should any of the cover layer transfer from the wrapping material to the wrapped article. Thus, in some instances, the cover layer could simply be a colorless (clear) coating. In the case of wrapping lumber, the coating 450 could have a beige, beige-like, or wood-colored appearance that is effective at limiting transfer of portions of the UV-blocking layer 442 onto the lumber. The wood-like color of the coating 450 can be achieved by pigments, fillers, etc. Because of its wood-like color, any transfer of portions of the cover layer 452 onto the lumber are less problematic and, thus, less likely to require remediation.

In some exemplary embodiments, the coatings 440 and 450 are co-extruded (that is, simultaneously applied) onto the inner face 406, with the coating 440 being applied directly onto the inner face 406 and the coating 450 being applied onto the coating 440. As a result, a thickness and/or weight of the layers 442, 452 can be more readily reduced as compared to the situation where the coatings 440 and 450 are separately extruded.

In general, co-extrusion refers to the extrusion of multiple layers of material simultaneously. This process utilizes multiple extruders to melt and deliver a steady volumetric throughput of different viscous resins to a single die and extrude the resin in the desired form. The layer thicknesses can be controlled by the relative speeds and sizes of the individual extruders delivering the materials.

In some exemplary embodiments, a (single ply, non-folded) thickness $WL_t$ of the sheet 402 (i.e., the woven polypropylene scrim) is in the range of 0.03 mm to 0.2 mm. In some exemplary embodiments, the thickness $WL_t$ is in the range of 0.033 mm to 0.07 mm. In some exemplary embodiments, the thickness $WL_t$ is about 0.058 mm.

In some exemplary embodiments, a thickness $ExL_t$ of the marking layer 432 is in the range of 0.01 mm to 0.04 mm. In some exemplary embodiments, the thickness $ExL_t$ is about 0.021 mm.

In some exemplary embodiments, a thickness $CoExL_t$ corresponding to the combined thicknesses of the UV-blocking layer 442 and the cover layer 452 is in the range of 0.01 mm to 0.04 mm. In some exemplary embodiments, the thickness $CoExL_t$ is about 0.021 mm.

In some exemplary embodiments the thickness $WL_t$ is greater than the sum of the thicknesses $ExL_t$ and $CoExL_t$.

In some exemplary embodiments the thickness $ExL_t$ is about the same (i.e., +/−50% and, in some instances, +/−10%) as the thickness $CoExL_t$.

In some exemplary embodiments, a weight/loading (gsm) of the polymer forming the sheet 402 (i.e., the woven polypropylene scrim) is in the range of 25 g/m$^2$ to 100 g/m$^2$. In some exemplary embodiments, the weight of the sheet 402 is in the range of 33 g/m$^2$ to 71 g/m$^2$. In some exemplary embodiments, the weight of the sheet 402 is about 58.3 g/m$^2$.

In some exemplary embodiments, a weight/loading (gsm) of the first polymeric coating 430 is in the range of 10 g/m$^2$ to 40 g/m$^2$. In some exemplary embodiments, the weight of the first polymeric coating 430 is in the range of 18 g/m$^2$ to 24 g/m$^2$. In some exemplary embodiments, the weight of the first polymeric coating 430 is about 21 g/m$^2$.

In some exemplary embodiments, a weight/loading (gsm) of the second polymeric coating 440 is in the range of 5 g/m$^2$ to 38 g/m$^2$. In some exemplary embodiments, the weight of the second polymeric coating 440 is in the range of 13.5 g/m$^2$ to 18 g/m$^2$. In some exemplary embodiments, the weight of the second polymeric coating 440 is about 14.5 g/m$^2$.

In some exemplary embodiments, a weight/loading (gsm) of the third polymeric coating 450 is in the range of 2 g/m$^2$ to 22 g/m$^2$. In some exemplary embodiments, the weight of the third polymeric coating 450 is in the range of 4.5 g/m$^2$ to 6 g/m$^2$. In some exemplary embodiments, the weight of the third polymeric coating 450 is about 6 g/m$^2$.

In some exemplary embodiments, a combined weight/loading (gsm) of the second polymeric coating 440 and the third polymeric coating 450 is in the range of 10 g/m$^2$ to 40 g/m$^2$. In some exemplary embodiments, the combined weight of the second and third polymeric coatings 440, 450 is in the range of 18 g/m$^2$ to 24 g/m$^2$. In some exemplary embodiments, the combined weight of the second and third polymeric coatings 440, 450 is about 20.5 g/m$^2$.

In some exemplary embodiments, the weight/loading of the first polymeric coating 430 is greater than the weight/loading of the second polymeric coating 440.

In some exemplary embodiments, the weight/loading of the first polymeric coating 430 is greater than the weight/loading of the third polymeric coating 450.

In some exemplary embodiments, the weight/loading of the second polymeric coating 440 is at least two times greater than the weight/loading of the third polymeric coating 450.

In some exemplary embodiments, the weight/loading of the second polymeric coating 440 is at least three times greater than the weight/loading of the third polymeric coating 450.

In some exemplary embodiments, the weight/loading of the third polymeric coating 450 is at least two times greater than the weight/loading of the second polymeric coating 440.

In some exemplary embodiments, the weight/loading of the third polymeric coating 450 is at least three times greater than the weight/loading of the second polymeric coating 440.

In some exemplary embodiments the weight/loading of the first polymeric coating 430 is about the same (i.e., +/−50% and, in some instances, +/−10%) as the combined weight of the second and third polymeric coatings 440, 450.

Because the second polymeric coating 440 and the third polymeric coating 450 are applied simultaneously (i.e., co-extruded), a thickness and/or weight of each of the coatings 440, 450 can be reduced relative to separately applying each coating. Likewise, the reduction in time and/or labor achieved by co-extruding the coatings 440, 450 is another advantage.

Figure 5:
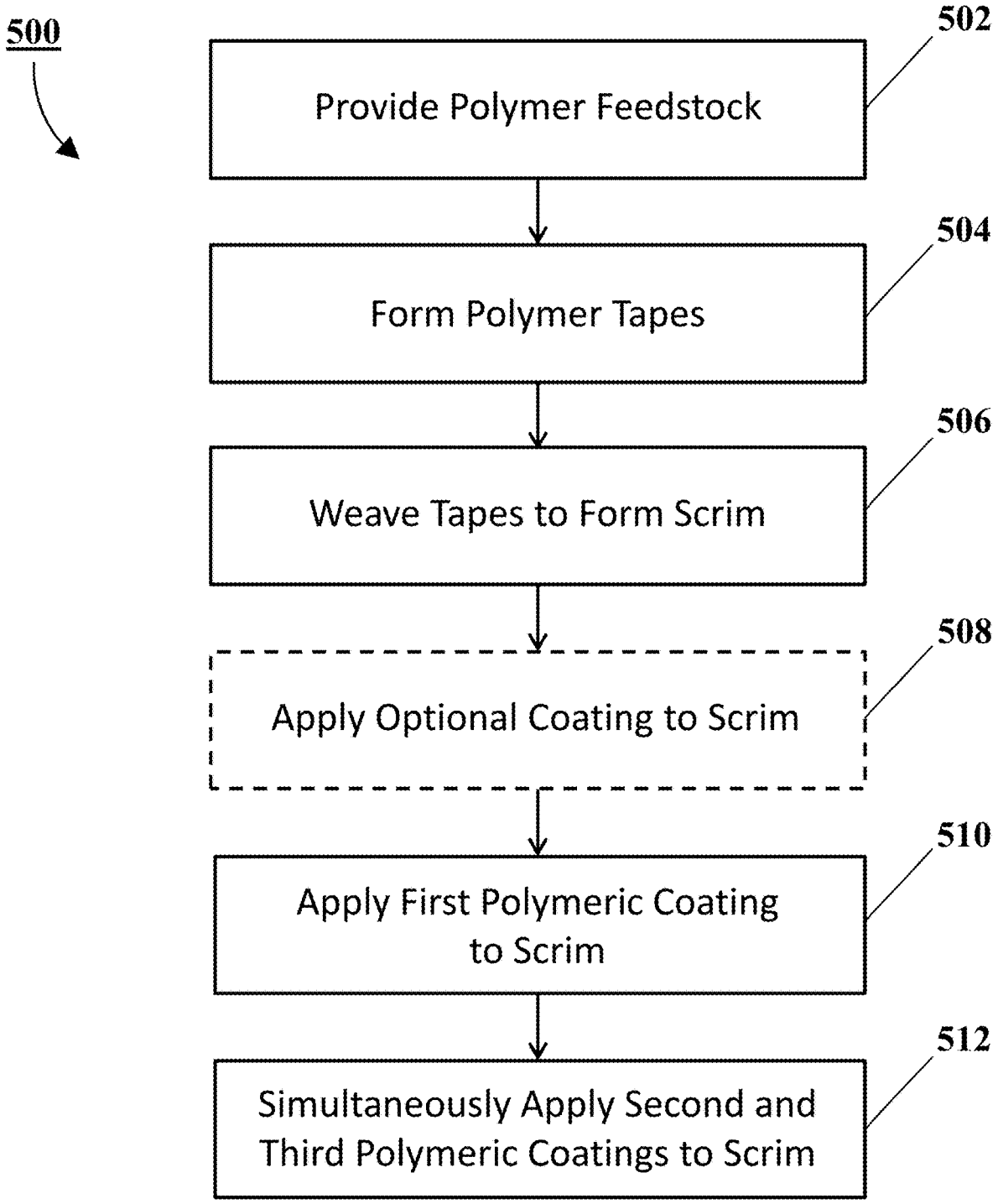
FIG. 5 is a flowchart of a method of forming a coated polymeric wrapping material, according to an exemplary embodiment.

An exemplary method 500 of forming a polymeric wrapping material (e.g., the polymeric wrapping material 400), which encompasses the general inventive concepts, is shown in FIG. 5.

As a first step, the method 500 contemplates provision of a polymer feedstock in step 502. Any suitable polymer can be used. In some exemplary embodiments, the polymer feedstock is polypropylene. In some exemplary embodiments, the polymer feedstock is polyethylene. In some exemplary embodiments, the polymer feedstock includes multiple distinct polymers.

Next, in step 504, the polymer feedstock is processed to form polymer tapes. As described herein, different polymer tapes (e.g., warp tapes 410, weft tapes 412) can be formed. The tapes can differ, for example, by width, weight, polymer type, etc.

In step 506, the polymer tapes are woven to form a polymeric scrim (e.g., the sheet 402). An optional coating (e.g., a polymeric coating) can be applied in step 508 to complete formation of the scrim. The optional coating is used to form the polymeric scrim, separate from the other functional coatings described herein. In some exemplary embodiments, the optional coating is substantially colorless (i.e., a clear coating).

Once the scrim has been formed, it is coated with a first polymeric coating (e.g., the coating 430) in step 510. For example, the first polymeric coating is extruded onto the scrim.

Finally, in step 512, a second polymeric coating (e.g., the coating 440) and a third polymeric coating (e.g., the coating 450) are simultaneously applied to the scrim. For example, the second and third polymeric coatings are co-extruded onto the scrim. In this example, the second polymeric coating directly contacts the scrim, while the third polymeric coating is separated from the scrim by the second polymeric coating.

An exemplary system 600 for wrapping a package 602 (e.g., lumber on a pallet) will be described with reference to FIGS. 6A-6C. The system 600 includes a roll 604 of wrapping material 606 (e.g., the wrapping material 400 described above). The package 602 rests on a surface 608. In some exemplary embodiments, the surface 608 is a conveyor (manual or automated) that moves in a direction indicated by the arrow 620. In the case of a conveyor, the package 602 can be moved into a desired position for wrapping.

Figure 6A:
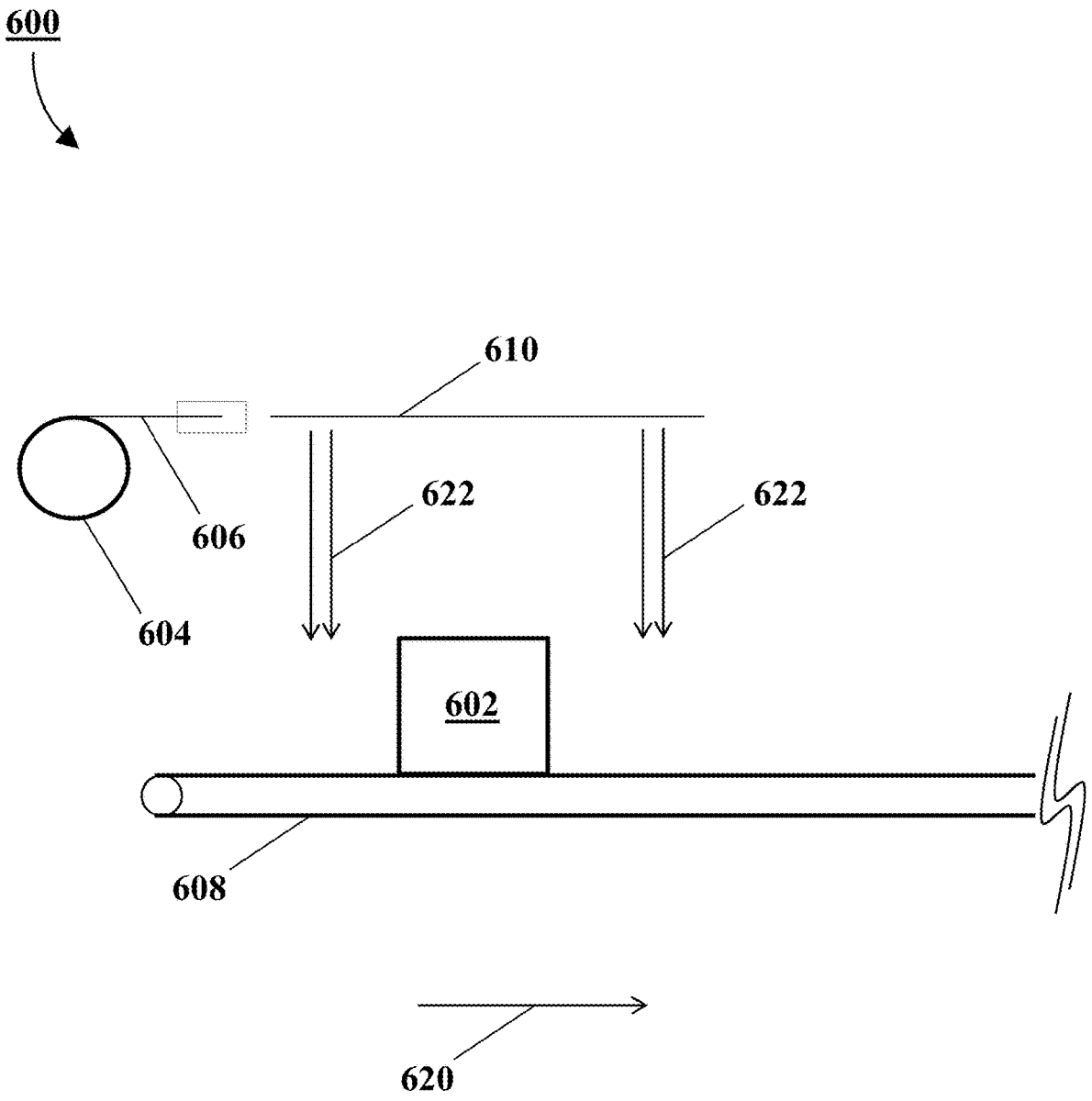
FIGS. 6A-6C illustrate a system for wrapping an article with a coated polymeric wrapping material, according to an exemplary embodiment.

As an initial step, a quantity of the wrapping material 606 is unrolled from the roll 604 and cut or otherwise separated therefrom to create a piece 610 of the wrapping material 606, as shown in FIG. 6A. The piece 610 of the wrapping material 606 is allowed to fall (in a controlled or uncontrolled manner) onto the package 602, as shown by the arrows 622.

Figure 6B:
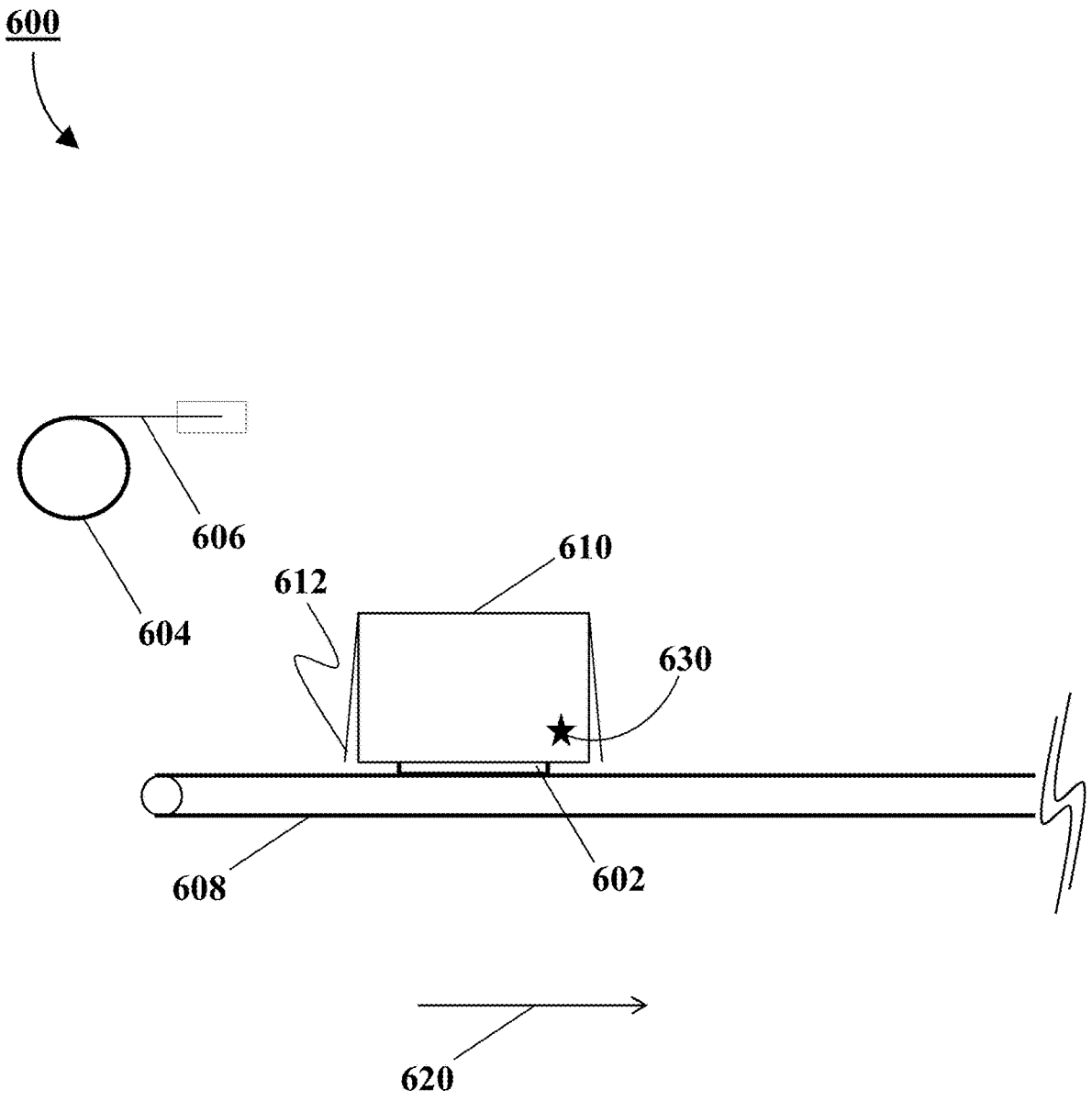

As the piece 610 of the wrapping material 606 drapes around the package 602, the piece 610 effectively covers a top surface of the package 602, as well as a substantial portion (if not all) of each of the four sides of the package 602 (see FIG. 6B). In this manner, ends/edges 612 of the piece 610 of the wrapping material 606 approach positions where the piece 610 can be attached directly to the package 602 or otherwise in a manner that secures the piece 610 relative to the package 602. In some exemplary embodiments, the regions 612 can be reinforced to better hold the fastening means (e.g., staples).

Figure 6C:
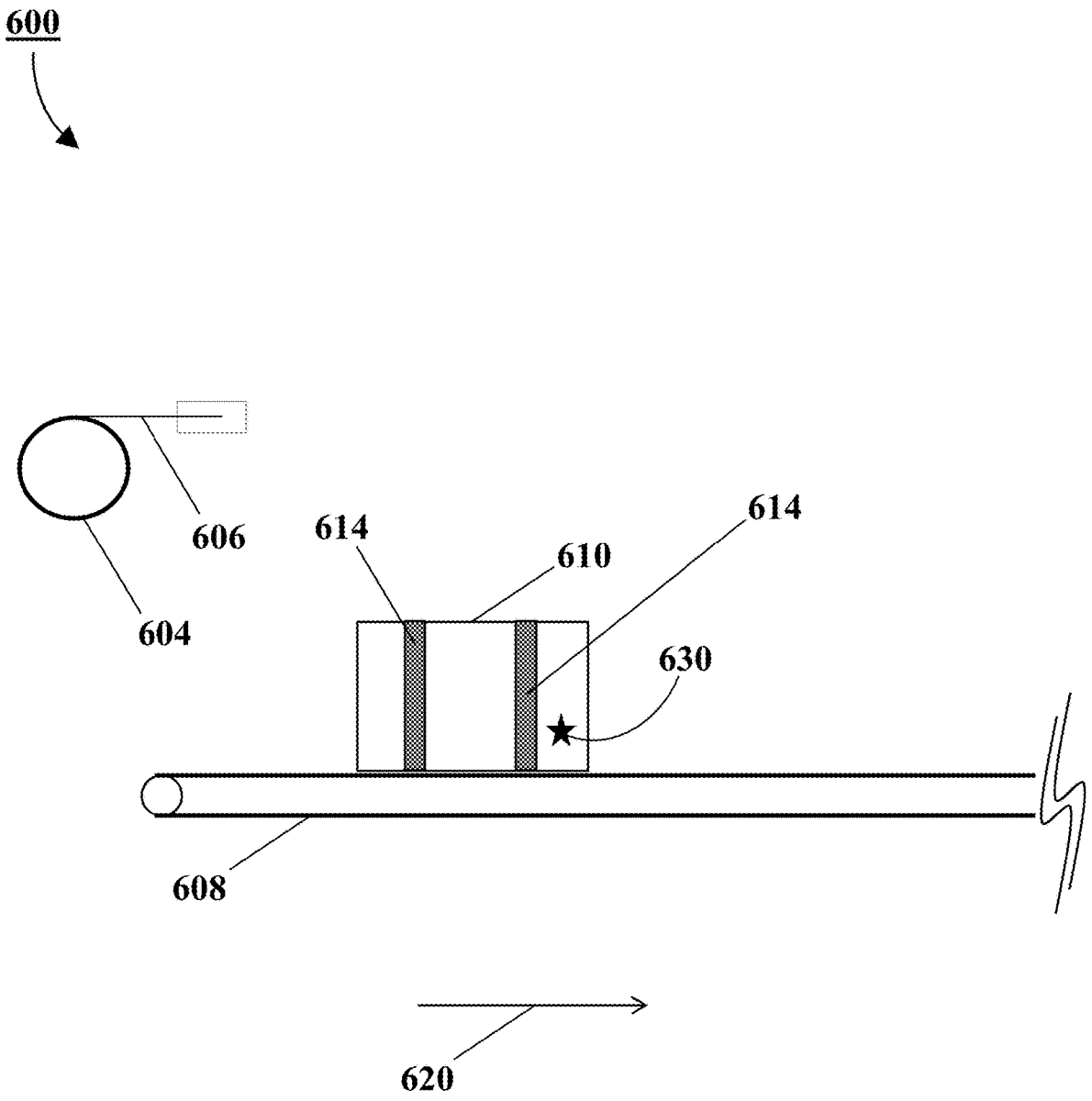

As the piece 610 of the wrapping material 606 is fully positioned on the package 602, one or more fasteners 614 (e.g., belts) are applied to secure the wrapping material 606 to or around the package 602 (see FIG. 6C). Thereafter, the wrapped package can be moved, such as along the surface 608, and another package 602 positioned on the surface 608 for wrapping with the wrapping material 606.

As shown in FIG. 6B, the wrapping material 606 can have information 630 (e.g., the indicia 408) printed on an outer surface of the wrapping material 606. The information 630 can include branding information (e.g., names, logos), information on the contents of the package 602 being wrapped, shipping information, regulatory information, etc.

Although the exemplary system 600 is described in the context of wrapping five sides of the package 602, it will be appreciated that the general inventive concepts encompass methods of wrapping fewer or more sides of a package.

The resulting improved polymeric wrapping materials disclosed and suggested herein (e.g., the wrapping material 400) are effective in wrapping large bulk items, such as lumber, while avoiding drawbacks (e.g., the discoloration of the lumber) resulting from conventional wrapping materials. Thus, costly and time-consuming remedies, such as sanding, cleaning, or otherwise treating affected portions of the lumber, can be avoided or at least mitigated.

In some embodiments, it may be possible to utilize the various aspects of the general inventive concepts introduced herein in combination with one another. Additionally, any particular element recited as relating to a particularly disclosed embodiment should be interpreted as available for use with all other disclosed or suggested embodiments, unless incorporation of the particular element would be contradictory to the express terms of the embodiment. Furthermore, all combinations of method or process steps as used herein can be performed in any order, unless otherwise specified or clearly implied to the contrary by logic or the context in which the referenced combination is made.

The scope of the general inventive concepts presented herein are not intended to be limited to the particular exemplary embodiments shown and described herein. From the disclosure given, those skilled in the art will not only understand the general inventive concepts and their attendant advantages, but will also find apparent various changes and modifications to the devices and systems disclosed. It is sought, therefore, to cover all such changes and modifications as fall within the spirit and scope of the general inventive concepts, as described and/or claimed herein, and any equivalents thereof.

What is claimed is:

1. A wrapping material comprising:

a sheet comprising a plurality of first polymeric tapes and a plurality of second polymeric tapes, the first and second polymeric tapes being interwoven;

a first polymeric coating applied to a first side of the sheet;

a second polymeric coating applied to a second side of the sheet; and a third polymeric coating applied to the second polymeric coating, wherein the second polymeric coating forms a UV-blocking layer of the wrapping material, the UV-blocking layer operable to block UV light from passing through the UV-blocking layer;

wherein the third polymeric coating forms a cover layer of the wrapping material; and wherein a combined thickness of the UV-blocking layer and the cover layer is in the range of 0.01 mm to 0.04 mm; and wherein the second polymeric coating and the third polymeric coating are co-extruded onto the second side of the sheet.

2. The wrapping material of claim 1, wherein the sheet has a width in the range of 1.22 m to 3.86 m.

3. The wrapping material of claim 1, wherein the sheet has a thickness in the range of 0.03 mm to 0.14 mm.

4. The wrapping material of claim 1, wherein the sheet has a weight in the range of 25 $g/m^2$ to 100 $g/m^2$.

5. The wrapping material of claim 1, wherein the first polymeric coating is substantially white in color.

6. The wrapping material of claim 1, wherein the first polymeric coating has an L* value>60, in the CIELAB color space.

7. The wrapping material of claim 1, wherein the first polymeric coating comprises at least one of polypropylene and polyethylene.

8. The wrapping material of claim 1, wherein the first polymeric coating forms a marking layer of the wrapping material, the marking layer suitable for printing indicia thereon.

9. The wrapping material of claim 8, wherein a thickness of the marking layer is in the range of 0.01 mm to 0.04 mm.

10. The wrapping material of claim 1, wherein a weight of the first polymeric coating is in the range of 10 $g/m^2$ to 40 $g/m^2$.

11. The wrapping material of claim 1, wherein the second polymeric coating is substantially black in color.

12. The wrapping material of claim 1, wherein the second polymeric coating has an L* value<30, in the CIELAB color space.

13. The wrapping material of claim 1, wherein the second polymeric coating comprises at least one of polypropylene and polyethylene.

14. The wrapping material of claim 1, wherein the second polymeric coating forms a UV-blocking layer of the wrapping material, the UV-blocking layer operable to block UV light from passing through the UV-blocking layer.

15. The wrapping material of claim 14, wherein a thickness of the UV-blocking layer is in the range of 0.005 mm to 0.038 mm.

16. The wrapping material of claim 1, wherein a weight of the second polymeric coating is in the range of 5 $g/m^2$ to 38 $g/m^2$.

17. The wrapping material of claim 1, wherein the third polymeric coating is darker than the first polymeric coating and lighter than the second polymeric coating.

18. The wrapping material of claim 1, wherein the third polymeric coating comprises at least one of polypropylene and polyethylene.

19. The wrapping material of claim 1, wherein the third polymeric coating forms a cover layer of the wrapping material.

20. The wrapping material of claim 19, wherein a thickness of the cover layer is in the range of 0.002 mm to 0.022 mm.

21. The wrapping material of claim 1, wherein a weight of the third polymeric coating is in the range of 2 $g/m^2$ to 22 $g/m^2$.

22. A method of manufacturing a wrapping material, the method comprising:

providing a polymer feedstock;

form first polymeric tapes from the feedstock;

form second polymeric tapes from the feedstock;

weaving the first polymeric tapes and the second polymeric tapes to form a polymeric scrim;

applying a first polymeric coating to a first side of the polymeric scrim; and co-extruding a second polymeric coating to a second side of the polymeric scrim and a third polymeric coating to the second polymeric coating, wherein the second polymeric coating forms a UV-blocking layer of the wrapping material, the UV-blocking layer operable to block UV light from passing through the UV-blocking layer;

wherein the third polymeric coating forms a cover layer of the wrapping material; and wherein a combined thickness of the UV-blocking layer and the cover layer is in the range of 0.01 mm to 0.04 mm.

* * * * *